US005419994A

United States Patent [19]

Honjo et al.

[11] Patent Number: 5,419,994

[45] Date of Patent: May 30, 1995

[54] CARRIER FOR ELECTROPHOTOGRAPHIC DEVELOPER, PROCESS FOR PREPARING THE SAME AND DEVELOPER PREPARED BY USING SAID CARRIER

[75] Inventors: Toshio Honjo; Yuji Sato; Kanao Kayamoto; Masahiro Ogata, all of Kashiwa, Japan

[73] Assignee: Powdertech Co., Ltd., Kashiwa, Japan

[21] Appl. No.: 939,989

[22] Filed: Sep. 3, 1992

Related U.S. Application Data

[63] Continuation-in-part of Ser. No. 621,596, Dec. 3, 1990, abandoned.

[30] Foreign Application Priority Data

Dec. 18, 1989 [JP] Japan ..... 1-325865
Sep. 17, 1990 [JP] Japan ..... 2-243752

[51] Int. Cl.[6] ..... G03G 9/107

[52] U.S. Cl. ..... 430/106.6; 430/108; 252/62.54; 252/62.55

[58] Field of Search ..... 430/106.6, 108; 252/62.54, 62.55

[56] References Cited

U.S. PATENT DOCUMENTS

| | | | |
|---|---|---|---|
| 4,076,640 | 2/1978 | Forgensi et al. | 252/62.1 |
| 4,126,437 | 11/1978 | O'Horo | 65/21 |
| 4,592,988 | 6/1986 | Aldrich et al. | 430/108 |
| 4,614,698 | 9/1986 | Miyakawa et al. | 430/106.6 |
| 4,781,753 | 11/1988 | Kopatz et al. | 75/0.513 |
| 4,950,570 | 8/1990 | Sano et al. | 430/102 |
| 4,996,126 | 2/1991 | Anno et al. | 430/106.6 |

FOREIGN PATENT DOCUMENTS 60-35764 2/1985 Japan .

*Primary Examiner*—Christopher D. Rodee
*Attorney, Agent, or Firm*—Bucknam and Archer

[57] ABSTRACT

An iron carrier for an electrophotographic developer, the carrier having a mean particle diameter of 25 to 40 μm, a magnetization of at least 160 emu/g at 3000 Oe, an apparent density of 3.0 to 4.2 g/cm$^3$, a percentage sphericity of at least 80%, and a specific surface area of at least 350 cm$^2$/g as determined by an air permeation method; a process for preparing the carrier by a plasma method; and an electrophotographic developer comprising the carrier.

5 Claims, 4 Drawing Sheets

CARRIER FOR ELECTROPHOTOGRAPHIC DEVELOPER, PROCESS FOR PREPARING THE SAME AND DEVELOPER PREPARED BY USING SAID CARRIER

This application is a Continuation-In-Part of Ser. No. 621,595 filed Dec. 3, 1990, now abandoned.

BACKGROUND OF THE INVENTION

1. Field of the Invention

The present invention relates to a carrier for an electrophotographic developer used in a copying machine, a printer, etc., for electrophotography, a process for preparing the same and a developer prepared by using said carrier.

2. Prior Art

Various carriers have hitherto been proposed, and examples thereof include those disclosed in U.S. Pat. Nos. 2,618,551, 2,638,416, 2,618,552, 3,526,533, 3,533,835 and 3,591,503.

Further, resin-coated carriers comprising carrier nucleus particles coated with various resins have been proposed for the purpose of prolonging the service life and regulating the amount of charge and resistance of the carrier. Materials such as nonmetals, metals and metal alloys, such as sand, cobalt, iron, copper, nickel, zinc, aluminum, brass, glass and ferrite, and composite metal oxides have been used as the carrier nucleus particle to be coated with the above-described resins.

Although a toner having a mean particle diameter of about 10 to 20 μm has hitherto been used as a developer, there is a tendency that the demand for a high image quality makes it necessary to reduce the particle diameter of the toner. With a reduction in the particle diameter of the toner, it is necessary to increase the specific surface area of the carrier with a view to increasing the capability of imparting a charge to the toner. In the conventional carrier, since the mean particle diameter is about 50 to 150 μm and the surface area is small, the increase in the capability of imparting a charge to the toner is unsatisfactory.

Although carriers in an irregular form having a mean particle diameter of 35 to 50 μm have been known, they are remarkably poor in the fluidity due to their irregular forms, so that the capability of imparting a charge to the toner is unsatisfactory.

In order to improve the fluidity, an attempt has been made on the sphering of the carrier, and atomizing granulation or the like is known as a means for attaining this purpose. However, it has been practically impossible to prepare a spherical powder having a size of 50 μm or less in a high yield:

SUMMARY OF THE INVENTION

An object of the present invention is to provide a carrier which, in order to cope with a reduction in the particle size of a toner, can increase the capability of imparting a charge to the toner and further increase the toner concentration, is less susceptible to a change in the image quality of a copy when the toner concentration somewhat changes, and can dispense with the toner concentration control device essential to the conventional copying machine; and a process for preparing the same. Further, a final object of the present invention is to improve the performance of an electrophotographic developer.

A toner is greatly influenced by the fluidity and specific surface area of the carrier. Specifically, the better the fluidity and the larger the specific surface area of the carrier, the greater the capability of the carrier to impart a charge to the toner. In particular, the fluidity of the toner per se becomes very poor with a reduction in the particle size of the toner, which makes it very important to take a measure through an improvement in the carrier.

The above-described objects of the present invention can be attained by making use of an iron carrier having particular properties satisfying the above-described characteristics requirements.

Specifically, the iron carrier for an electrophotographic developer of the present invention is characterized by having a mean particle diameter of 25 to 40 μm, a magnetization of at least 160 emu/g at 3000 Oe, an apparent density of 3.0 to 4.2 g/cm$^3$, a specific surface area of at least 350 cm$^2$/g and a percentage sphericity of at least 80%.

DETAILED EXPLANATION OF THE INVENTION

There is no particular limitation on the raw material for the carrier used in the present invention, and any of the raw materials known in the art may be used. Examples thereof include iron, ferrite, cobalt, copper, nickel and carborundum, among which iron and ferrite are particularly preferred.

The mean particle diameter of the iron carrier of the present invention is 25 to 40 μm. When it is less than 25 μm, the magnetization of the carrier particle becomes so low that the carrier scatters. On the other hand, when it exceeds 40 μm, the specific surface area of the carrier lowers, which is liable to cause the toner to scatter. Therefore, both the above cases are unfavorable.

The magnetization of the iron carrier of the present invention is preferable to at least 100 emu/g, preferably to at least 160 emu/g at 3000 Oe. When it is less than 100 emu/g, the carrier tends to scatter. A problem which occurs when the particle size of the carrier is reduced to the above-described value is that the magnetization per carrier particle becomes low due to a reduction in the weight (volume) per carrier particle. This makes it necessary to bring the magnetization to a certain value or above. The magnetization at 3000 Oe can be increased to at least 100 emu/g by selecting the raw materials for the carrier. It is also possible to regulate the magnetization through control of an atmosphere in which the carrier is sphered and recovered. A carrier having a magnetization exceeding 190 emu/g at 3000 Oe can be practically produced in a case where an oxygen concentration in the process is extremely lowered.

The apparent density of the carrier of the present invention is 3.0 to 4.2 g/cm$^3$. When it is less than 3.0 g/cm$^3$, the fluidity of the carrier tends to lower. On the other hand, when it exceeds 4.2 g/cm$^3$, ears of a magnetic brush become so hard that the fluidity of the carrier becomes poor. Further, in this case, the stress applied to the toner is increased, which shortens the service life of the developer.

In the present invention, the carrier should be spherical. A high fluidity can be obtained through the sphering of the carrier. The term "spherical carrier" as used herein is intended to mean one wherein when the carrier is observed under a scanning electron microscope, particles having a major axis to minor axis ratio of 1.0 to 1.25 amount to 80% or more of the carrier, that is, one having a percentage sphericity of 80% or more.

In the carrier used in the present invention, it is desired that the specific surface area determined by the air permeation method according to the Kozeny-Carman method (for example, by making use of SS-100 manufactured by Shimadzu Seisakusho Ltd., Japan) be 350 $cm^2/g$ or more, and this enables the carrier to have a capability of imparting a sufficient property of charging the toner.

As described above, the fluidity and specific surface area of the carrier have a great influence on the charge imparting property of the toner. However, it is possible to greatly change the absolute value through the coating of the surface of the carrier with a resin.

In the conventional carrier having a large mean particle diameter, it has been usual practice to conduct thick film coating by making use of a large amount of a resin for the purpose of improving the image quality through an enhancement in the resistance. In the carrier having a small mean particle diameter of the present invention, however, as compared with the conventional coated carrier, it is easy to conduct coating and obtain a high image quality for the reason that, even when the coating layer is thin, the resistance is increased due to an increase in the number of carrier particles. There is no particular limitation on the resin to be used, and examples of the resin include those known as a coating resin for a carrier nucleus particle in the art, such as natural resins, thermoplastic resins and partially cured thermosetting resins.

A process for preparing an iron carrier for an electrophotographic developer of this invention and a plasma apparatus for use in the process will be hereinafter described.

The carrier made of iron of this invention is prepared by melting a carrier raw material using a plasma method.

More particularly, the iron carrier of this invention is prepared by throwing, as a raw material for the carrier, iron powder containing at least 80% of metallic iron and having a mean particle size or diameter of 25 to 50 μm into a DC plasma torch using at least one member selected from the group consisting of helium, argon, nitrogen and hydrogen as a plasma gas, to melt spray the iron powder, and then recovering the sprayed melt in a spray chamber maintained at a reduced gas pressure of less than 550 Torr to obtain the iron carrier. The reason why the plasma method is employed for the preparation of the carrier is that desired properties such as desired particle size, magnetization and apparent density can be obtained on the carrier so prepared.

The plasma apparatus for use in the preparation of the iron carrier of this invention comprises a plasma torch, a spray chamber, a powder container, a gas-control unit, a raw-material feeding unit, a power unit and an exhaustion system.

FIGS. 2, 3 and 4, schematically illustrate a direct current (PC) plasma torch, a radio frequency (RF) plasma torch and a hybrid plasma torch as the plasma torch of the above plasma apparatus, respectively (In the DC plasma torch, the anode is made of copper and the cathode made of tungsten.).

In the process for preparing the iron carrier for an electrophotographic developer of this invention, any types of the above-mentioned plasma torches can be used in accordance with the purpose for which they are used.

The RF plasma torch is advantageous in its capability of enhancing a percentage of sphericity of the resulting carrier since the RF plasma torch allows a raw material for the carrier to reside in the plasma flame for a long time and facilitates the supply of the raw material therein due to the fact that said plasma torch is low in plasma flow rate and is large in flame as compared with the DC plasma torch. The RF plasma torch will raise a problem that the plasma flame thereof has a tendency to become unstable when a supply of the raw material increases.

However, the hybrid plasma torch in which the DC plasma torch is combined with the RF plasma torch is said to be the most superior among these plasma torches since the DC plasma torch performs its role as a seed fire or fire source, whereby the plasma is stabilized thereby to enable a large quantity of the raw material to be sphered.

Control factors to efficiently prepare a powdery carrier having a good percentage sphericity include the inside pressure of a spray chamber, the kind of a plasma gas, the particle size distribution of a raw material for the carrier, the quantity of the raw material supplied and the amount of the plasma gas fed.

It is preferable to maintain the inside pressure of the spray chamber at a reduced pressure of less than 550 Torr since the raw material can be supplied properly and satisfactorily when the pressure within the spray chamber is reduced. When the pressure within the spray chamber is higher than 550 Torr, the outlet of the plasma torch through which the raw material is fed, will result in being partially clogged up since it becomes difficult to smoothly supply the raw material from a feeder to the torch. As a result of this, it is liable to cause troubles such as lowering of the percentage sphericity or perfect clogging of the outlet for the raw material of the plasma torch used since the raw material changes its discharge direction whereby it is made difficult to enter into the plasma flame.

In a case where the sphering of iron powder as a raw material for the carrier is carried out in an atmosphere containing oxygen gas, there is a tendency of further improving the percentage sphericity due to oxidation heat of the iron powder, while the magnetization thereof is inversely lowered by the oxidation. Thus, it is necessary to substitute the atmosphere with an inert gas depending on the purpose for which the resulting carrier is used.

As a plasma gas, argon gas (At) is generally used. The percentage sphericity can be improved by using a gas mixture prepared by incorporating argon gas with some amount of helium gas (He), hydrogen gas ($H_2$) or nitrogen gas ($N_2$) which have a higher thermal conductivity than argon gas. These gases can be used in an optional mixing proportion.

It is preferable to use an iron powder containing at least 80% of metallic iron as a raw material in the preparation of the carrier of this invention. In the case where an iron powder containing less than 80% of metallic iron as a raw material is used, a carrier having a saturated magnetization of 160 emu/g or more cannot be obtained.

It is preferable to use a raw material having as narrow particle size distribution as possible, and a desired mean particle size is preferably in the range of from 25 to 50 μm. In a case where a raw material contains large-sized particles having a mean particle size larger than 50 μm, there are possibilities that the sphering of the raw material is difficult and, further, the supply thereof from a feeder is unlikely to be carried out smoothly. In addition, it is not preferable to use a raw material which contains fine particles having a mean particle size smaller than 25 μm, since such a raw material is lowered in fluidity, and, when the raw material is supplied into the plasma flame, the fine particles contained therein are vaporized to produce super-fine particles in a large amount which are attached to the surfaces of the resulting sphered carrier particles so that they hinder the fluidity of the carrier particles, and further it is very difficult to separate the super-fine particles from the carrier particles.

The apparent density of a raw material to be used is preferable to be not larger than 4.2 g/cm$^3$ since the apparent density after being sphered grows larger than the raw material used.

Although the supply of the raw material can be controlled by the volume of a feed gas (At) fed into the plasma torch, it is necessary to determine the amount of the raw material supplied in accordance with the output of a plasma apparatus to be used because the raw material decreases in percent sphericity when it is supplied in an excessive amount. In the case where a direct current plasma torch having an output of 50 KW is used, it is preferable to supply the raw material in an amount of about 35 Kg per hour at the most.

A developer prepared from a toner and the carrier thus obtained has very excellent performance.

THE PREFERRED EMBODIMENTS

The present invention will now be described in more detail by the following Examples and Comparative Examples with reference to the accompanying drawings.

EXAMPLE 1

Figure 1:
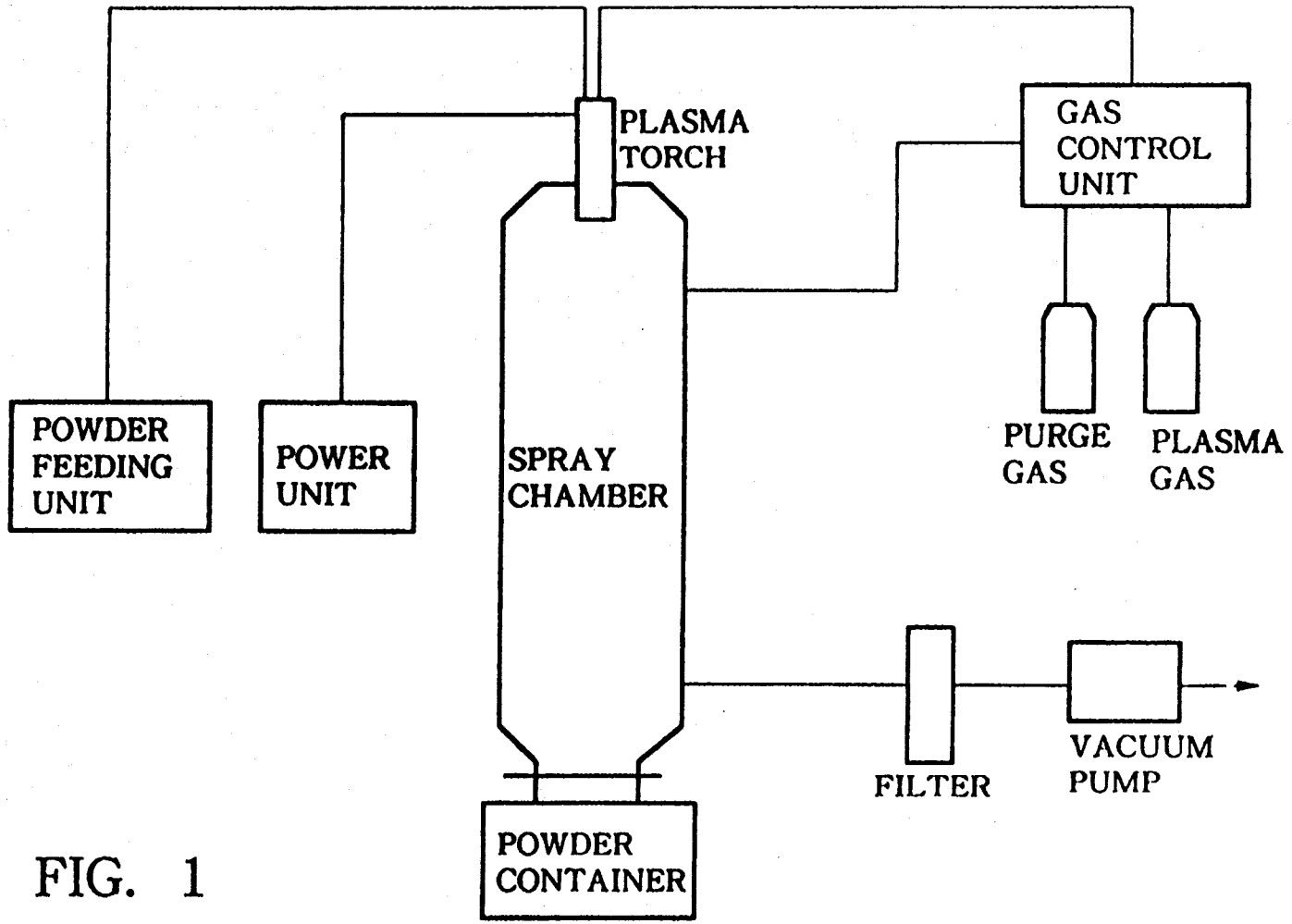
FIG. 1 is a block diagram illustrating the plasma apparatus used in the process for preparing the carrier by a plasma method according to the present invention.
Figure 2:
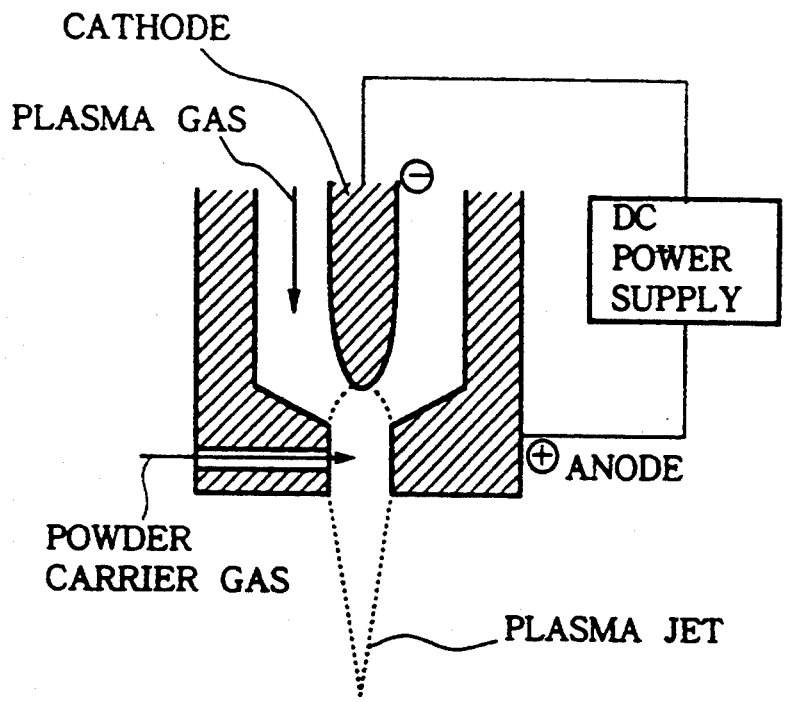
FIG. 2 is a cross-sectional view of a direct current (DC) plasma torch for use in the the plasma apparatus.

Using a DC plasma apparatus as shown in FIG. 1, the interior of a spray chamber was purged with an inert gas and then reduced in inert gas pressure to 50 Torr. Irregular form iron particles having a mean particle size of about 40 μm and an apparent density of 2.53 g/cm$^3$ were thrown by a feeder at a rate of 25 Kg/hr into a DC plasma flame produced in a DC plasma torch having an output of 50 KW (FIG. 2) and using therein argon gas as a plasma gas at a flow rate of 60 liter/min., so that spherical carrier particles having a mean particle size of about 31 μm were obtained.

As shown in Table 1, the thus obtained carrier particles had a magnetization of 170 emu/g at 3000 Oe, an apparent density of 3.56 g/cm$^3$ and a specific surface area of 420 cm$^2$/g.

The above-described carrier was observed under a scanning electron microscope and found to have a percentage sphericity of 80% or more.

A developer was prepared from the above-prepared carrier and a toner (a styrene-acrylic resin) and then subjected to a test by the use of a commercially available actual copying machine.

The toner concentration at this time was The image properties (image density, fogging, scratching mark, scattering of carrier, service life, and overall evaluation) are given in Table 1. In Table 1, ⊙, , Δ, and X represent "excellent", "good", "slightly poor" and "poor", respectively.

EXAMPLE 2

The surface of the carrier prepared in Example 1 was coated with an acrylic resin.

A developer was prepared from the resin-coated carrier thus prepared and the same toner as used in Example 1 and then subjected to a test by the use of a commercially available actual copying machine.

The toner concentration at this time was 124. The image properties are given in Table 1.

EXAMPLE 3

Using a DC plasma apparatus as shown in FIG. 1, the interior of a spray chamber was purged with an inert gas and then reduced in inert gas pressure to 50 Torr. Irregular form iron particles having the same mean particle diameter as shown in Example 1 were thrown by a feeder at a rate of 25 Kg/hr into a DC plasma flame produced in a DC plasma torch having an output of 50 KW shown in FIG. 2, in which torch a mixture of argon gas (45 l/min) and helium gas (15 l/min) as a plasma gas was supplied so that spherical carrier particles having a mean particle size or diameter of about 30 μm were obtained.

As shown in Table 1, the thus prepared carrier had a magnetization of 172 emu/g at 3000 Oe, an apparent density of 3.72 g/cm$^3$ and a specific surface area of 413 cm$^2$/g.

The carrier thus prepared was observed by a scanning electron microscope and found to have a percentage sphericity of 85% or more.

A developer was prepared from the above-prepared carrier and the same toner as used in Example. 1 and then subjected to a test by the use of a commercially available actual copying machine.

The toner concentration at this time was 15%. The image properties are given in Table 1.

EXAMPLE 4

Using a DC plasma apparatus as shown in FIG. 1, the interior of a spray chamber was purged with an inert gas and then reduced in inert gas pressure to 100 Torr. Irregular form iron particles having a mean particle diameter of about 40 μm and an apparent density of 2.65 g/cm$^3$ were thrown by a feeder at a rate of 25 Kg/hr into a DC plasma flame produced in a DC plasma torch having an output of 50 KW (FIG. 2) in which argon gas as a plasma gas was supplied at a flow rate of 60 liter/min., so that spherical carrier particles having a mean particle diameter of about 31.5 μm were obtained.

As shown in Table 1, the thus prepared carrier had a magnetization of 175 emu/g at 3000 Oe, an apparent density of 3.72 g/cm$^3$ and specific surface area of 418 cm$^2$/g.

The above-described carrier was observed by the use of a scanning electron microscope and found to have a percentage sphericity of 80% more.

A developer was prepared from the above-prepared carrier and the same toner as used in Example 1 and then subjected to a test by the use of a commercially available actual copying machine. The image properties are given in Table 1.

EXAMPLE 5

Using a DC plasma apparatus as shown in FIG. 1, the interior of a spray chamber was purged with an inert gas and then reduced in inert gas pressure to 450 Torr. Irregular form iron particles having a mean particle diameter of about 45 μm and a apparent density of 3.21 g/cm$^3$ were thrown by a feeder at a rate of 25 Kg/hr into 10 a DC plasma flame produced in a DC plasma torch having an output of 50 KW (FIG. 2) in which a mixture of argon gas (50 l/min) and hydrogen gas (10 l/min) was supplied as a plasma gas, thereby to prepare spherical carrier particles having a mean particle diameter of about 35 μm were obtained.

As shown in Table 1, the thus prepared carrier had a magnetization of 179 emu/g at 3000 Oe, an apparent density of 3.81 g/cm$^3$ and a specific surface area of 408 cm$^2$/g.

The above-described carrier was observed by a scanning electron microscope and found to have a percentage sphericity of 85% or more.

A developer was prepared by making use of the above-prepared carrier and the toner used in Example 1 and subjected to a test through the use of a commercially available actual copying machine.

The toner concentration at this time was The image properties are given in Table 1.

EXAMPLE 6

The procedure of Example 5 was followed except that the interior of the spray chamber, a powder feeding unit and a piping line were purged with an inert gas three times and then reduced in inert gas pressure to 450 Torr.

As shown in Table 1, the thus obtained carrier particles had a mean particle diameter of about 35 μm, a magnetization of 199 emu/g at 3000 Oe, an apparent density of 3.97 g/cm$^3$, a specific surface area of 398 cm$^2$/g and a percentage sphericity of 85% or more.

The surface of the thus obtained carrier was coated with an acrylic resin.

A developer was prepared from the resin-coated carrier thus prepared and the same toner as used in Example 1 and then subjected to a test by the use of a commercially available actual copying machine.

The toner concentration at this time was 12%. The image properties are given in Table 1.

EXAMPLE 7

Figure 3:
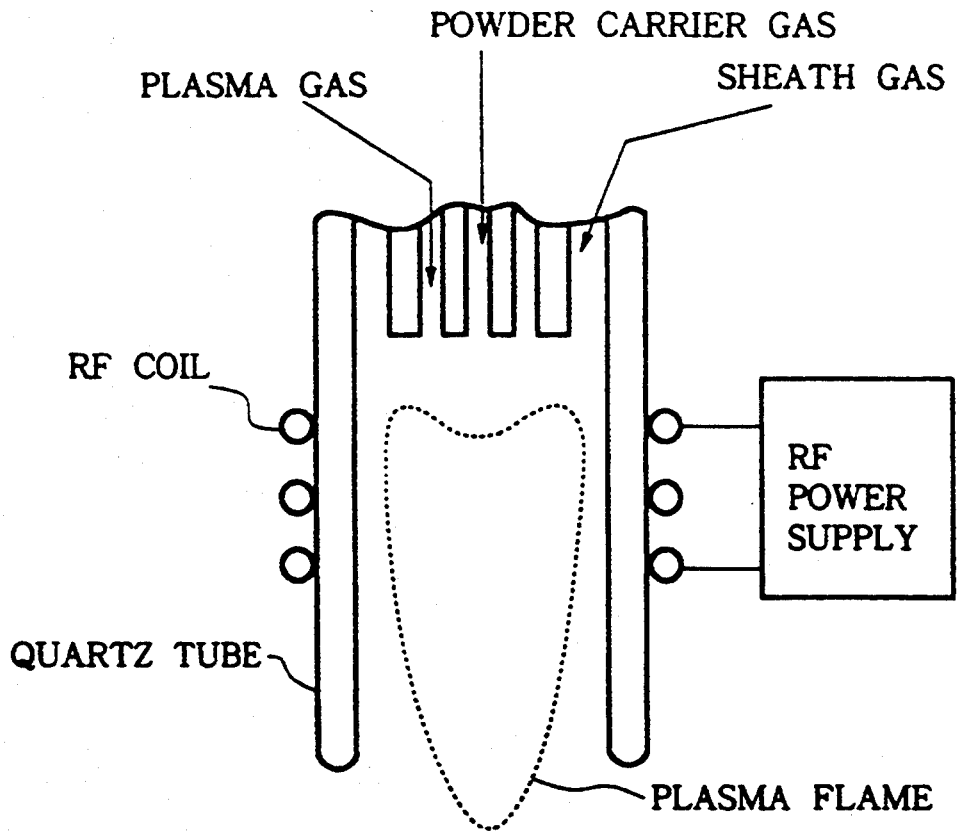
FIG. 3 is a cross-sectional view of a radio frequency (RF) plasma torch for use in the the plasma apparatus.

Using a plasma apparatus as shown in FIG. 1, the interior of a spray chamber was purged with an inert gas and then reduced in gas pressure to 500 Torr. Irregular form iron particles having a mean particle diameter of about 40 μm and a apparent density of 2.53 g/cm$^3$ were thrown by a feeder at a rate of 25 Kg/hr into a RF plasma flame produced in a RF plasma torch having an output of 50 KW (FIG. 3) in which a mixture of argon gas and hydrogen gas was supplied as a plasma gas at flow rates of 50 and 10 liter/min., respectively, so that spherical carrier particles having a mean particle diameter of about 30.5 μm were obtained.

As shown in Table 1, the thus prepared carrier had a magnetization of 175 emu/g at 3000 Oe, an apparent density of 3.56 g/cm$^3$ and a specific surface area of 420 cm$^2$/g.

The above-described carrier was observed by a scanning electron microscope and found to have a percentage sphericity of 90% or more.

A developer was prepared from the above-prepared carrier and the same toner as used in Example 1 and then subjected to a test by the use of a commercially available actual copying machine.

The toner concentration at this time was 15%. The image properties are given in Table 1.

EXAMPLE 8

The surface of the carrier prepared in Example 7 was coated with the same acrylic resin as used in Example 2.

A developer was prepared from the thus resin-coated carrier and the same toner as used in Example 1 and then subjected to a test by the use of an actual copying machine.

The toner concentration at this time was 15%. The image properties are given in Table 1.

EXAMPLE 9

Figure 4:
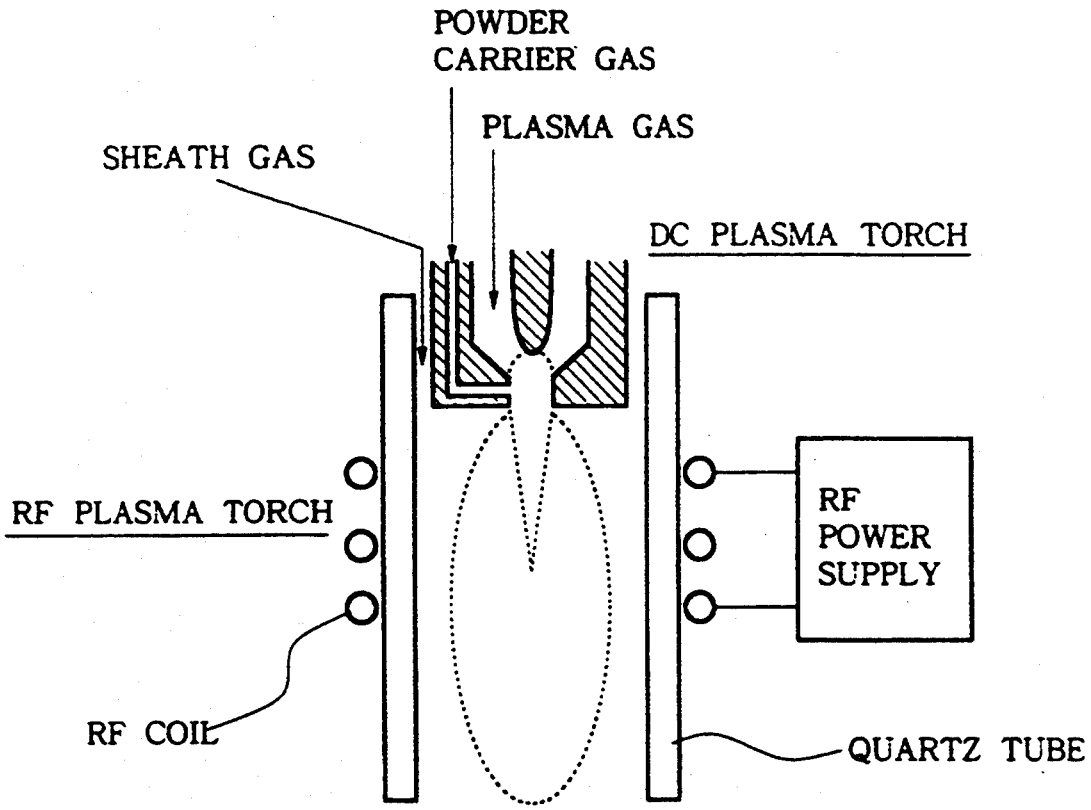
FIG. 4 is a cross-sectional view of a hybrid plasma torch for use in the plasma apparatus.

Using a plasma apparatus as shown in FIG. 1, the interior of a spray chamber was purged with an inert gas and then reduced in gas pressure to 400 Torr. Irregular form iron particles having a mean particle diameter of about 40 μm and a apparent density of 2.53 g/cm$^3$ were thrown by a feeder at a rate of 25 Kg/hr into a hybrid plasma flame produced in a hybrid plasma torch having a total output of 65 KW (15 KW of a direct plasma torch and 50 KW of a RF plasma torch) as shown in FIG. 4, in which torch argon gas was supplied as a plasma gas at a flow rate of 80 liter/min., so that spherical carrier particles having a mean particle diameter of about 29 μm were obtained.

As shown in Table 1, the thus prepared carrier had a magnetization of 172 emu/g at 3000 Oe, an apparent density of 3.59 g/cm$^3$ and a specific surface area of 435 cm$^2$/g.

The above-described carrier particles were observed by a scanning electron microscope and found to have a percentage sphericity of 95% or more.

The surfaces of the carrier particles were coated with the same acrylic resin as used in Example 2.

A developer was prepared from the coated carrier and the same toner as used in Example 1, and a test was conducted on the developer thus prepared by the use of an actual copying machine.

The toner concentration at this time was 15%. The image properties are given in Table 1.

Comparative Example 1

Using a DC plasma apparatus as shown in FIG. 1, the interior of a spray chamber was purged with an inert gas and then reduced in inert gas pressure to 100 Torr. Irregular form iron particles having a mean particle diameter of about 22 μm and a apparent density of 1.86 g/cm$^3$ were thrown by using a feeder at a rate of 20 Kg/hr into a DC plasma flame produced in a DC plasma torch having a capacity of 50 KW (FIG. 2) in which argon gas as a plasma gas was supplied at a flow rate of 60 liter/min., so that spherical carrier particles having a mean particle diameter of about 14.5 μm were obtained.

As shown in Table 1, the thus prepared carrier had a magnetization of 170 emu/g at 3000 Oe, an apparent density of 2.2 g/cm$^3$ and a specific surface area of 671 cm$^2$/g.

The above-described carrier was observed by a scanning electron microscope and found to have a percentage sphericity of 80% or more.

A developer was prepared from the above-prepared carrier and the same toner as used in Example 1 and then subjected to a test by the use of a commercially available actual copying machine, and it was appreciated that the carrier was partially attached to the resulting image. The image properties are given in Table 1.

Comparative Example 2

The procedure of Comparative Example 1 was followed except that irregular form iron particles 10 having & particle size of about 60 μm and a apparent density of 3.28 g/cm$^3$ were used, so that spherical carrier particles having a mean particle diameter of about 53 μm were obtained.

As shown in Table 1, the thus obtained carrier had a magnetization of 175 emu/g at 3000 Oe, an apparent density of 3.92 g/cm$^3$ and a specific surface area of 343 cm$^2$/g.

The above-described carrier was observed by a scanning electron microscope and found to have a percentage sphericity of 80% or more.

A developer was prepared from the thus obtained carrier and the same toner as used in Example 1 and then subjected to a test by the use of a commercially available actual copying machine with the result that the toner partially scattered onto a non-image portion thereby to stain said portion therewith. The image properties are given in Table 1.

Comparative Example 3

The procedure of Comparative Example 1 was followed except that irregular form atomized iron particles having a mean particle diameter of about 49 μm and a apparent density of 4.22 g/cm$^3$ were used, so that spherical carrier particles having a mean particle diameter of about 40 μm were obtained.

As shown in Table 1, the thus prepared carrier had a magnetization of 175 emu/g at 3000 Oe, an apparent density of 4.4 g/cm$^3$and a specific surface area of 355 cm$^2$/g.

The above-described carrier was observed by the use of a scanning electron microscope and found to have a percentage sphericity of 80% or more.

A developer was prepared from the above-prepared carrier and the same toner as used in Example 1 and then subjected to a test by the use of a commercially available actual copying machine. The test result showed that the image density obtained was sufficient but scratch marks by the magnetic brush occurred. The image properties are given in Table 1.

Comparative Example 4

Using a DC plasma apparatus as shown in FIG. 1, the interior of a spray chamber was purged with an inert gas and then reduced in inert gas pressure to 680 Torr. Irregular form iron particles having a mean particle diameter of about 40 μm and a apparent density of 2.53 g/cm$^3$ were thrown by a feeder at a rate of 25 Kg/hr into a DC plasma flame produced in a DC plasma torch having an output of 50 KW (FIG. 2) in which argon gas as a plasma gas was supplied at a flow rate of 60 liter/-min., so that spherical carrier particles having a mean particle diameter of about 32.5 μm were prepared.

As shown in Table 1, the thus prepared carrier had a magnetization of 178 emu/g at 3000 Oe, an apparent density of 3.69 g/cm$^3$ and a specific surface area of 429 cm$^2$/g.

The above-described carrier was observed by a scanning electron microscope and found to have a percentage sphericity of only about 50% or so.

A developer was prepared from the above-prepared carrier and the same toner as used in Example 1 and then subjected to a test by the use of a commercially available actual copying machine. The test result showed that ears on the magnetic brush were irregular, the image was significantly rough, and the fluidity of the developer was remarkably poor. The image properties are given in Table 1.

Comparative Example 5

A developer was prepared from spherical iron carrier ASR-1020 (mean particle diameter: 100 μm) (a product of Powdertech Co., Ltd., Japan) produced by the atomization method and having properties specified in Table 1, and the same toner as used in Example 1, after which the thus prepared developer was subjected to a test by the use of a commercially available actual copying machine.

The toner concentration at this time was 2.5%. The image properties are given in Table 1.

Comparative Example 6

The surface of the carrier obtained in Comparative Example 5 was coated with an acrylic resin.

A developer was prepared from the resin-coated carrier thus prepared and the same toner as used in Example 1, and then subjected to a test by the use of a commercially available actual copying machine.

The toner concentration at this time was 2.5%. The image properties are given in Table 1.

TABLE 1

| | Ex. and Comp. Ex. | | | | | | | | |
|---|---|---|---|---|---|---|---|---|---|
| Properties | Ex. 1 | Ex. 2 | Ex. 3 | Ex. 4 | Ex. 5 | Ex. 6 | Ex. 7 | Ex. 8 | Ex. 9 |
| carrier properties (core) | | | | | | | | | |
| apparent density (g/cm$^3$) | 3.56 | 3.56 | 3.72 | 3.72 | 3.81 | 3.97 | 3.56 | 3.56 | 3.59 |
| specific surface area (cm$^2$/g) | 420 | 420 | 413 | 418 | 408 | 398 | 420 | 420 | 435 |
| mean particle diameter (m) | 31 | 31 | 30 | 31.5 | 35 | 35 | 30.5 | 30.5 | 29 |
| magnetization (emu/g) | 170 | 170 | 172 | 175 | 179 | 199 | 175 | 175 | 172 |
| percentage sphericity (%) | >80 | >80 | >85 | >80 | >85 | >85 | >90 | >90 | >95 |
| fludity | Δ | Δ | Δ~○ | Δ | Δ~○ | Δ~○ | ○ | ○ | ◎ |
| image properties | | | | | | | | | |
| image density | ○ | ○ | ○ | ○ | ○ | ○ | ○ | ○ | |
| fogging | ○ | ○ | ○ | ○ | ○ | ○ | ○ | ○ | |
| scratch mark | Δ | Δ~○ | Δ | Δ | Δ | Δ | ○ | ○ | ◎ |
| scattering of carrier | ○ | ○ | ○ | ○ | ○ | ○ | ○ | ○ | |
| service life | ○ | ◎ | ○ | ○ | ○ | ◎ | ○ | ◎ | ◎ |

TABLE 1-continued

| overall evaluation | Δ | Δ | Δ | Δ | Δ | Δ | ○ | ○ | ◎ |
|---|---|---|---|---|---|---|---|---|---|
| | Ex. and Comp. Ex. | | | | | | | | |
| | Comp. Ex. 1 | Comp. Ex. 2 | Comp. Ex. 3 | Comp. Ex. 4 | Comp. Ex. 5 | Comp. Ex. 6 | | | |
| carrier properties (core) | | | | | | | | | |
| apparent density (g/cm$^3$) | 2.20 | 3.92 | 4.40 | 3.69 | 4.43 | 4.43 | | | |
| specific surface area (cm$^2$/g) | 671 | 343 | 355 | 429 | 98 | 98 | | | |
| mean particle diameter (m) | 14.5 | 53 | 40 | 32.5 | 100 | 100 | | | |
| magnetization (emu/g) | 170 | 175 | 175 | 178 | 190 | 190 | | | |
| percentage sphericity (%) | >80 | >80 | >80 | 50 | >95 | >95 | | | |
| fludity | X | Δ~○ | ○ | X | ◎ | ◎ | | | |
| image properties | | | | | | | | | |
| image density | ○ | Δ | ○~Δ | Δ | X | X | | | |
| fogging | ○ | X | ○ | X | Δ | ○ | | | |
| scratch mark | Δ | Δ | Δ | X | Δ | ○ | | | |
| scattering of carrier | X | ○ | ○ | ○ | ○ | ○ | | | |
| service life | Δ | Δ | Δ~○ | X | X | Δ | | | |
| overall evaluation | X | X | X | X | X | X | | | |

What is claimed is:

1. An iron carrier for an electrophotographic developer, the carrier having a mean particle size of 25 to 40 μm, a magnetization of at least 160 emu/g at 3000 Oe, the apparent density of 3.0 to 4.2 g/cm$^3$ and a percentage sphericity of at least 80%, and a specific surface area of at least 350 cm$^2$/g as determined by an air permeation method according to the Kozeny-Carman method.

2. An electrophotographic developer comprising a toner and a coated carrier prepared by coating the surface of a carrier according to claim 1 with a resin.

3. The developer according to claim 2 wherein said resin is an acrylic resin.

4. The carrier according to claim 1 wherein said carrier has particles at least 80% of which have a ratio of the major axis to the minor axis of 1.0 to 1.25.

5. The carrier according to claim 1 wherein the magnetization is 170–199 emu/g at 3000 Oe, the apparent density is 3.56–3.97 g/cm$^3$, the specific surface area is 398–435 cm$^2$/g and the mean particle diameter is 29–35 μm.

* * * * *